US009082387B2

(12) United States Patent
Hendrix et al.

(10) Patent No.: US 9,082,387 B2
(45) Date of Patent: Jul. 14, 2015

(54) NOISE BURST ADAPTATION OF SECONDARY PATH ADAPTIVE RESPONSE IN NOISE-CANCELING PERSONAL AUDIO DEVICES

(71) Applicant: Cirrus Logic, Inc., Austin, TX (US)

(72) Inventors: Jon D. Hendrix, Wimberly, TX (US); Jeffrey Alderson, Austin, TX (US); Antonio John Miller, Austin, TX (US); Yang Lu, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 456 days.

(21) Appl. No.: 13/722,119

(22) Filed: Dec. 20, 2012

(65) Prior Publication Data

US 2013/0301842 A1 Nov. 14, 2013

Related U.S. Application Data

(60) Provisional application No. 61/645,138, filed on May 10, 2012.

(51) Int. Cl.

| | |
|---|---|
| ***G10K 11/16*** | (2006.01) |
| ***G10K 11/00*** | (2006.01) |
| ***G10K 11/178*** | (2006.01) |

(52) U.S. Cl.

CPC ..... *G10K 11/002* (2013.01); *G10K 11/1788* (2013.01); *G10K 2210/108* (2013.01); *G10K 2210/3049* (2013.01)

(58) Field of Classification Search

CPC ..... G10K 11/002
USPC ..... 381/13, 71.1, 71.2, 71.6–71.14, 73.1, 381/94.1, 94.8, 317; 379/22.08, 390.02, 379/392.01, 406.08; 455/67.1, 67.13, 455/114.2, 222, 223, 277.2, 296, 299, 306, 455/310, 501, 570

See application file for complete search history.

(56) References Cited

U.S. PATENT DOCUMENTS

| | | | |
|---|---|---|---|
| 5,251,263 | A | 10/1993 | Andrea et al. |
| 5,278,913 | A | 1/1994 | Delfosse et al. |

(Continued)

FOREIGN PATENT DOCUMENTS

| | | | |
|---|---|---|---|
| DE | 102011013343 | A1 | 9/2012 |
| EP | 1880699 | A2 | 1/2008 |

(Continued)

OTHER PUBLICATIONS

U.S. Appl. No. 13/686,353, filed Nov. 27, 2012, Hendrix, et al.

(Continued)

*Primary Examiner* — Md S Elahee
(74) *Attorney, Agent, or Firm* — Mitch Harris, Atty at Law, LLC; Andrew M. Harris

(57) ABSTRACT

A personal audio device, such as a wireless telephone, generates an anti-noise signal from an error microphone signal and injects the anti-noise signal into the speaker or other transducer output to cause cancellation of ambient audio sounds. The error microphone is also provided proximate the speaker to provide an error signal indicative of the effectiveness of the noise cancellation. A secondary path estimating adaptive filter is used to estimate the electro-acoustical path from the noise canceling circuit through the transducer so that source audio can be removed from the error signal. Noise bursts are injected intermittently and the adaptation of the secondary path estimating adaptive filter controlled, so that the secondary path estimate can be maintained irrespective of the presence and amplitude of the source audio.

42 Claims, 8 Drawing Sheets

(56) References Cited

U.S. PATENT DOCUMENTS 5,321,759 A 6/1994 Yuan
5,337,365 A 8/1994 Hamabe et al.
5,359,662 A 10/1994 Yuan et al.
5,410,605 A 4/1995 Sawada et al.
5,425,105 A 6/1995 Lo et al.
5,445,517 A 8/1995 Kondou et al.
5,465,413 A 11/1995 Enge et al.
5,548,681 A 8/1996 Gleaves et al.
5,586,190 A 12/1996 Trantow et al.
5,640,450 A 6/1997 Watanabe
5,699,437 A 12/1997 Finn
5,706,344 A 1/1998 Finn
5,740,256 A 4/1998 Castello Da Costa et al.
5,768,124 A 6/1998 Stothers et al.
5,815,582 A 9/1998 Claybaugh et al.
5,832,095 A 11/1998 Daniels
5,946,391 A 8/1999 Dragwidge et al.
5,991,418 A 11/1999 Kuo
6,041,126 A 3/2000 Terai et al.
6,118,878 A 9/2000 Jones
6,219,427 B1 4/2001 Kates et al.
6,278,786 B1 8/2001 McIntosh
6,282,176 B1 8/2001 Hemkumar
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran
6,768,795 B2 7/2004 Feltstrom et al.
6,850,617 B1 2/2005 Weigand
6,940,982 B1 9/2005 Watkins
7,058,463 B1 6/2006 Ruha et al.
7,103,188 B1 9/2006 Jones
7,181,030 B2 2/2007 Rasmussen et al.
7,330,739 B2 2/2008 Somayajula
7,365,669 B1 4/2008 Melanson
7,680,456 B2 3/2010 Muhammad et al.
7,742,790 B2 6/2010 Konchitsky et al.
7,817,808 B2 10/2010 Konchitsky et al.
8,019,050 B2 9/2011 Mactavish et al.
8,249,262 B2 8/2012 Chua et al.
8,290,537 B2 10/2012 Lee et al.
8,325,934 B2 12/2012 Kuo
8,379,884 B2 2/2013 Horibe et al.
8,401,200 B2 3/2013 Tiscareno et al.
8,442,251 B2 5/2013 Jensen et al.
8,908,877 B2 12/2014 Abdollahzadeh Milani et al.
2001/0053228 A1 12/2001 Jones
2002/0003887 A1 1/2002 Zhang et al.
2003/0063759 A1 4/2003 Brennan et al.
2003/0185403 A1 10/2003 Sibbald
2004/0047464 A1 3/2004 Yu et al.
2004/0165736 A1 8/2004 Hetherington et al.
2004/0167777 A1 8/2004 Hetherington et al.
2004/0202333 A1 10/2004 Csermak et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0035593 A1 2/2006 Leeds
2006/0069556 A1 3/2006 Nadjar et al.
2006/0153400 A1 7/2006 Fujita et al.
2007/0030989 A1 2/2007 Kates
2007/0033029 A1 2/2007 Sakawaki
2007/0038441 A1 2/2007 Inoue et al.
2007/0053524 A1 3/2007 Haulick et al.
2007/0076896 A1 4/2007 Hosaka et al.
2007/0154031 A1 7/2007 Avendano et al.
2007/0258597 A1 11/2007 Rasmussen et al.
2007/0297620 A1 12/2007 Choy
2008/0019548 A1 1/2008 Avendano
2008/0107281 A1 5/2008 Togami et al.
2008/0144853 A1 6/2008 Sommerfeldt et al.
2008/0177532 A1 7/2008 Greiss et al.
2008/0181422 A1 7/2008 Christoph
2008/0226098 A1 9/2008 Haulick et al.
2008/0240455 A1 10/2008 Inoue et al.
2008/0240457 A1 10/2008 Inoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124336 A1 5/2010 Shridhar et al.
2010/0124337 A1 5/2010 Wertz et al.
2010/0131269 A1 5/2010 Park et al.
2010/0150367 A1 6/2010 Mizuno
2010/0158330 A1 6/2010 Guissin et al.
2010/0166203 A1 7/2010 Peissig et al.
2010/0195838 A1 8/2010 Bright
2010/0195844 A1 8/2010 Christoph et al.
2010/0207317 A1 8/2010 Iwami et al.
2010/0246855 A1 9/2010 Chen
2010/0272276 A1 10/2010 Carreras et al.
2010/0272283 A1 10/2010 Carreras et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0322430 A1 12/2010 Isberg
2011/0007907 A1* 1/2011 Park et al. ..... 381/71.8
2011/0106533 A1 5/2011 Yu
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0158419 A1 6/2011 Theverapperuma et al.
2011/0206214 A1 8/2011 Christoph et al.
2011/0222698 A1 9/2011 Asao et al.
2011/0249826 A1 10/2011 Van Leest
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0207317 A1 8/2012 Abdollahzadeh Milani et al.
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0300958 A1 11/2012 Klemmensen
2012/0300960 A1 11/2012 Mackay et al.
2012/0308021 A1 12/2012 Kwatra et al.

(56) References Cited

U.S. PATENT DOCUMENTS

| | | | |
|---|---|---|---|
| 2012/0308024 | A1 | 12/2012 | Alderson et al. |
| 2012/0308025 | A1 | 12/2012 | Hendrix et al. |
| 2012/0308026 | A1 | 12/2012 | Kamath et al. |
| 2012/0308027 | A1 | 12/2012 | Kwatra |
| 2012/0308028 | A1 | 12/2012 | Kwatra et al. |
| 2012/0310640 | A1 | 12/2012 | Kwatra et al. |
| 2013/0010982 | A1 | 1/2013 | Elko et al. |
| 2013/0083939 | A1 | 4/2013 | Fellers et al. |
| 2013/0243225 | A1 | 9/2013 | Yokota |
| 2013/0272539 | A1 | 10/2013 | Kim et al. |
| 2013/0287218 | A1 | 10/2013 | Alderson et al. |
| 2013/0287219 | A1 | 10/2013 | Hendrix et al. |
| 2013/0301846 | A1 | 11/2013 | Alderson et al. |
| 2013/0301847 | A1 | 11/2013 | Alderson et al. |
| 2013/0301848 | A1 | 11/2013 | Zhou et al. |
| 2013/0301849 | A1 | 11/2013 | Alderson et al. |
| 2013/0343556 | A1 | 12/2013 | Bright |
| 2013/0343571 | A1 | 12/2013 | Rayala et al. |
| 2014/0044275 | A1 | 2/2014 | Goldstein et al. |
| 2014/0050332 | A1 | 2/2014 | Nielsen et al. |
| 2014/0086425 | A1 | 3/2014 | Jensen et al. |
| 2014/0177851 | A1 | 6/2014 | Kitazawa et al. |
| 2014/0211953 | A1 | 7/2014 | Alderson et al. |
| 2014/0270222 | A1 | 9/2014 | Hendrix et al. |
| 2014/0270223 | A1 | 9/2014 | Li et al. |
| 2014/0270224 | A1 | 9/2014 | Zhou et al. |
| 2015/0092953 | A1 | 4/2015 | Abdollahzadeh Milani et al. |

FOREIGN PATENT DOCUMENTS

| | | | |
|---|---|---|---|
| EP | 1947642 | A1 | 7/2008 |
| EP | 2133866 | A1 | 12/2009 |
| EP | 2216774 | A1 | 8/2010 |
| EP | 2395500 | A1 | 12/2011 |
| EP | 2395501 | A1 | 12/2011 |
| GB | 2401744 | A | 11/2004 |
| GB | 2455821 | A | 6/2009 |
| GB | 2455824 | A | 6/2009 |
| GB | 2455828 | A | 6/2009 |
| GB | 2484722 | A | 4/2012 |
| JP | H06-186985 | A | 7/1994 |
| WO | WO 03/015074 | A1 | 2/2003 |
| WO | WO 03015275 | A1 | 2/2003 |
| WO | WO 2004009007 | A1 | 1/2004 |
| WO | WO 2004017303 | A1 | 2/2004 |
| WO | WO 2007007916 | A1 | 1/2007 |
| WO | WO 2007113487 | A1 | 11/2007 |
| WO | WO 2010117714 | A1 | 10/2010 |
| WO | WO 2012134874 | A1 | 10/2012 |

OTHER PUBLICATIONS

U.S. Appl. No. 13/795,160, filed Mar. 12, 2013, Hendrix, et al.
U.S. Appl. No. 13/692,367, filed Dec. 3, 2012, Alderson, et al.
U.S. Appl. No. 13/727,718, filed Dec. 27, 2012, Alderson, et al.
U.S. Appl. No. 13/784,018, filed Mar. 4, 2013, Alderson, et al.
U.S. Appl. No. 13/787,906, filed Mar. 7, 2013, Alderson, et al.
U.S. Appl. No. 13/729,141, filed Dec. 28, 2012, Zhou, et al.
U.S. Appl. No. 13/794,931, filed Mar. 12, 2013, Lu, et al.
U.S. Appl. No. 13/794,979, filed Mar. 12, 2013, Alderson, et al.
Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.
Toochinda, et al. "A Single-Input Two-Output Feedback Formulation for ANC Problems," Proceedings of the 2001 American Control Conference, Jun. 2001, pp. 923-928, vol. 2, Arlington, VA.
Kuo, et al., "Active Noise Control: A Tutorial Review," Proceedings of the IEEE, Jun. 1999, pp. 943-973, vol. 87, No. 6, IEEE Press, Piscataway, NJ.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.
Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMS Algorithm and its Derivatives," International Journal of Recent Trends in Engineering, May 2009, pp. 323-328, vol. 1, No. 1, Academy Publisher.
Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
Jin, et al. "A simultaneous equation method-based online secondary path modeling algorithm for active noise control", Journal of Sound and Vibration, Apr. 25, 2007, pp. 455-474, vol. 303, No. 3-5, London, GB.
Erkelens, et al., "Tracking of Nonstationary Noise Based on Data-Driven Recursive Noise Power Estimation", IEEE Transactions on Audio Speech and Language Processing, Aug. 2008, pp. 1112-1123, vol. 16, No. 6, Piscataway, NJ, US.
Rao, et al., "A Novel Two State Single Channel Speech Enhancement Technique", India Conference (INDICON) 2011 Annual IEEE, IEEE, Dec. 2011, 6 pages (pp. 1-6 in pdf), Piscataway, NJ, US.
Rangachari, et al., "A noise-estimation algorithm for highly non-stationary environments", Speech Communication, Feb. 2006, pp. 220-231, vol. 48, No. 2. Elsevier Science Publishers.
U.S. Appl. No. 13/968,007, filed Aug. 15, 2013, Hendrix, et al.
Parkins, et al., "Narrowband and broadband active control in an enclosure using the acoustic energy density", J. Acoust. Soc. Am. Jul. 2000, pp. 192-203, vol. 108, issue 1, US.
Feng, et al.., "A broadband self-tuning active noise equaliser", Signal Processing, Oct. 1, 1997, pp. 251-256, vol. 62, No. 2, Elsevier Science Publishers B.V. Amsterdam, NL.
Zhang, et al., "A Robust Online Secondary Path Modeling Method with Auxiliary Noise Power Scheduling Strategy and Norm Constraint Manipulation", IEEE Transactions on Speech and Audio Processing, IEEE Service Center, Jan. 1, 2003, pp. 45-53, vol. 11, No. 1, NY.
Lopez-Gaudana, et al., "A hybrid active noise cancelling with secondary path modeling", 51st Midwest Symposium on Circuits and Systems, MWSCAS 2008, Aug. 10-13, 2008, pp. 277-280, IEEE, Knoxville, TN.
International Search Report and Written Opinion in PCT/US2013/036531, mailed on May 12, 2014, 12 pages (pp. 1-12 in pdf).
U.S. Appl. No. 14/029,159, filed Sep. 17, 2013, Li, et al.
U.S. Appl. No. 14/062,951, filed Oct. 25, 2013, Zhou, et al.
U.S. Appl. No. 14/228,322, filed Mar. 28, 2014, Alderson, et al.
U.S. Appl. No. 13/762,504, filed Feb. 8, 2013, Abdollahzadeh Milani, et al.

(56) References Cited

OTHER PUBLICATIONS

U.S. Appl. No. 13/721,832, filed Dec. 20, 2012, Lu, et al.
U.S. Appl. No. 13/724,656, filed Dec. 21, 2012, Lu, et al.
U.S. Appl. No. 14/252,235, filed Apr. 14, 2014, Lu, et al.
U.S. Appl. No. 13/968,013, filed Aug. 15, 2013, Abdollahzadeh Milani, et al.
U.S. Appl. No. 13/924,935, filed Jun. 24, 2013, Hellman.
U.S. Appl. No. 13/896,526, filed May 17, 2013, Naderi.
U.S. Appl. No. 14/101,955, filed Dec. 10, 2013, Alderson.
U.S. Appl. No. 14/101,777, filed Dec. 10, 2013, Alderson et al.
Abdollahzadeh Milani, et al., "On Maximum Achievable Noise Reduction in ANC Systems",2010 IEEE International Conference on Acoustics Speech and Signal Processing, Mar. 14-19, 2010, pp. 349-352, Dallas, TX, US.
Cohen, Israel, "Noise Spectrum Estimation in Adverse Environments: Improved Minima Controlled Recursive Averaging", IEEE Transactions on Speech and Audio Processing, Sep. 2003, pp. 1-11, vol. 11, Issue 5, Piscataway, NJ, US.
Ryan, et al., "Optimum Near-Field Performance of Microphone Arrays Subject to a Far-Field Beampattern Constraint", J. Acoust. Soc. Am., Nov. 2000, pp. 2248-2255, 108 (5), Pt. 1, Ottawa, Ontario, Canada.
Cohen, et al., "Noise Estimation by Minima Controlled Recursive Averaging for Robust Speech Enhancement", IEEE Signal Processing Letters, Jan. 2002, pp. 12-15, vol. 9, No. 1, Piscataway, NJ, US.
Martin, Rainer, "Noise Power Spectral Density Estimation Based on Optimal Smoothing and Minimum Statistics", IEEE Transactions on Speech and Audio Processing, Jul. 2001, pp. 504-512, vol. 9, No. 5, Piscataway, NJ, US.
Martin, Rainer, "Spectral Subtraction Based on Minimum Statistics", Signal Processing VII Theories and Applications, Proceedings of EUSIPCO-94, 7th European Signal Processing Conference, Sep. 13-16, 1994, pp. 1182-1185, vol. III, Edinburgh, Scotland, U.K.
Booij, et al., "Virtual sensors for local, three dimensional, broadband multiple-channel active noise control and the effects on the quiet zones", Proceedings of the International Conference on Noise and Vibration Engineering, ISMA 2010, Sep. 20-22, 2010, pp. 151-166, Leuven.
Kuo, et al., "Residual noise shaping technique for active noise control systems", J. Acoust. Soc. Am. 95 (3), Mar. 1994, pp. 1665-1668.
Lopez-Caudana, Edgar Omar, "Active Noise Cancellation: The Unwanted Signal and the Hybrid Solution", Adaptive Filtering Applications, Dr. Lino Garcia (Ed.), Jul. 2011, pp. 49-84, ISBN: 978-953-307-306-4, InTech.
Senderowicz, et al., "Low-Voltage Double-Sampled Delta-Sigma Converters", IEEE Journal on Solid-State Circuits, Dec. 1997, pp. 1907-1919, vol. 32, No. 12, Piscataway, NJ.
Hurst, et al., "An improved double sampling scheme for switched-capacitor delta-sigma modulators", 1992 IEEE Int. Symp. On Circuits and Systems, May 10-13, 1992, vol. 3, pp. 1179-1182, San Diego, CA.
U.S. Appl. No. 14/578,567, filed Dec. 22, 2014, Kwatra, et al.
Widrow, B., et al., Adaptive Noise Cancelling; Principles and Applications, Proceedings of the IEEE, Dec. 1975, pp. 1692-1716, vol. 63, No. 13, IEEE, New York, NY, US.
Morgan, et al., A Delayless Subband Adaptive Filter Architecture, IEEE Transactions on Signal Processing, IEEE Service Center, Aug. 1995, pp. 1819-1829, vol. 43, No. 8, New York, NY, US.
Written Opinion of the International Preliminary Examining Authority in PCT/US2013/036531 mailed on Oct. 9, 2014, 6 pages (pp. 1-6 in pdf).
International Preliminary Report on Patentability in PCT/US2013/036531 mailed on Dec. 11, 2014, 25 pages (pp. 1-25 in pdf).
Black, John W., "An Application of Side-Tone in Subjective Tests of Microphones and Headsets", Project Report No. NM 001 064.01.20, Research Report of the U.S. Naval School of Aviation Medicine, Feb. 1, 1954, 12 pages (pp. 1-12 in pdf), Pensacola, FL, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
U.S. Appl. No. 14/197,814, filed Mar. 5, 2014, Kaller, et al.
U.S. Appl. No. 14/210,537, filed Mar. 14, 2014, Abdollahzadeh Milani, et al.
U.S. Appl. No. 14/210,589, filed Mar. 14, 2014, Abdollahzadeh Milani, et al.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Therrien, et al., "Sensory Attenuation of Self-Produced Feedback: The Lombard Effect Revisited", PLOS One, Nov. 2012, pp. 1-7, vol. 7, Issue 11, e49370, Ontario, Canada.

* cited by examiner

NOISE BURST ADAPTATION OF SECONDARY PATH ADAPTIVE RESPONSE IN NOISE-CANCELING PERSONAL AUDIO DEVICES

This U.S. Patent Application Claims priority under 35 U.S.C. 119(e) to U.S. Provisional Patent Application Ser. No. 61/645,138 filed on May 10, 2012.

BACKGROUND OF THE INVENTION

1. Field of the Invention

The present invention relates generally to personal audio devices such as wireless telephones that include adaptive noise cancellation (ANC), and more specifically, to control of ANC in a personal audio device that uses injected noise bursts to provide adaptation of a secondary path estimate.

2. Background of the Invention

Wireless telephones, such as mobile/cellular telephones, cordless telephones, and other consumer audio devices, such as MP3 players, are in widespread use. Performance of such devices with respect to intelligibility can be improved by providing noise canceling using a microphone to measure ambient acoustic events and then using signal processing to insert an anti-noise signal into the output of the device to cancel the ambient acoustic events.

Noise canceling operation can be improved by measuring the transducer output of a device at the transducer to determine the effectiveness of the noise canceling using an error microphone. The measured output of the transducer is ideally the source audio, e.g., downlink audio in a telephone and/or playback audio in either a dedicated audio player or a telephone, since the noise canceling signal(s) are ideally canceled by the ambient noise at the location of the transducer. To remove the source audio from the error microphone signal, the secondary path from the transducer through the error microphone can be estimated and used to filter the source audio to the correct phase and amplitude for subtraction from the error microphone signal. However, when source audio is absent, the secondary path estimate cannot typically be updated. Further, at the beginning of a telephone conversation, when source audio of sufficient amplitude may or may not become immediately available, the secondary path may have a different response than the secondary path had the last time that source audio was available to train the secondary path adaptive filter.

Therefore, it would be desirable to provide a personal audio device, including wireless telephones, that provides noise cancellation using a secondary path estimate to measure the output of the transducer and that can adapt the secondary path estimate independent of whether source audio of sufficient amplitude is present.

SUMMARY OF THE INVENTION

The above stated objective of providing a personal audio device providing noise cancelling including a secondary path estimate that can be adapted whether or not source audio has been present, is accomplished in a personal audio device, a method of operation, and an integrated circuit.

The personal audio device includes a housing, with a transducer mounted on the housing for reproducing an audio signal that includes both source audio for providing to a listener and an anti-noise signal for countering the effects of ambient audio sounds in an acoustic output of the transducer. An error microphone is mounted on the housing to provide an error microphone signal indicative of the transducer output and the ambient audio sounds. The personal audio device further includes an adaptive noise-canceling (ANC) processing circuit within the housing for adaptively generating an anti-noise signal from the error microphone signal such that the anti-noise signal causes substantial cancellation of the ambient audio sounds. The processing circuit controls adaptation of a secondary path adaptive filter for compensating for the electro-acoustical path from the output of the processing circuit through the transducer. The ANC processing circuit injects noise bursts and permits the secondary path adaptive filter to adapt during the noise bursts, in order to properly model the secondary path.

The foregoing and other objectives, features, and advantages of the invention will be apparent from the following, more particular, description of the preferred embodiment of the invention, as illustrated in the accompanying drawings.

DESCRIPTION OF ILLUSTRATIVE EMBODIMENT

The present invention encompasses noise canceling techniques and circuits that can be implemented in a personal audio device, such as a wireless telephone. The personal audio device includes an adaptive noise canceling (ANC) circuit that measures the ambient acoustic environment and generates a signal that is injected into the speaker (or other transducer) output to cancel ambient acoustic events. A reference microphone is provided to measure the ambient acoustic environment, and an error microphone is included to measure the ambient audio and transducer output at the transducer, thus giving an indication of the effectiveness of the noise cancelation. A secondary path estimating adaptive filter is used to remove the playback audio from the error microphone signal, in order to generate an error signal. However, depending on the presence (and level) of the audio signal reproduced by the personal audio device, e.g., downlink audio during a telephone conversation or playback audio from a media file/connection, the secondary path adaptive filter may not be able to continue to adapt to estimate the secondary path. Further, at the beginning of a telephone conversation, not only may downlink audio be absent, but any previous secondary path model may be inaccurate due to a different position of the wireless telephone with respect to the user's ear. Therefore, the present invention uses injected noise bursts to provide enough energy for the secondary path estimating adaptive filter to continue to adapt, in a manner that is unobtrusive to the user.

Figure 1:
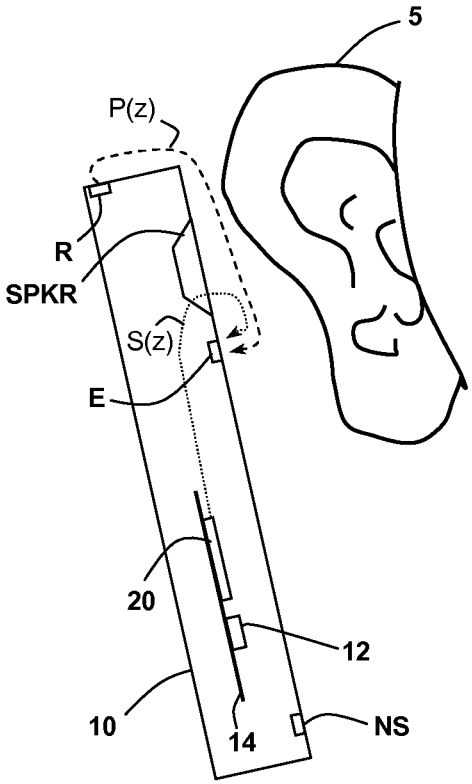
FIG. 1 is an illustration of an exemplary wireless telephone 10.

FIG. 1 shows an exemplary wireless telephone 10 in proximity to a human ear 5. Illustrated wireless telephone 10 is an example of a device in which techniques illustrated herein may be employed, but it is understood that not all of the elements or configurations embodied in illustrated wireless telephone 10, or in the circuits depicted in subsequent illustrations, are required. Wireless telephone 10 includes a transducer such as speaker SPKR that reproduces distant speech received by wireless telephone 10, along with other local audio events such as ringtones, stored audio program material, near-end speech, sources from web-pages or other network communications received by wireless telephone 10 and audio indications such as battery low and other system event notifications. A near-speech microphone NS is provided to capture near-end speech, which is transmitted from wireless telephone 10 to the other conversation participant(s).

Wireless telephone 10 includes adaptive noise canceling (ANC) circuits and features that inject an anti-noise signal into speaker SPKR to improve intelligibility of the distant speech and other audio reproduced by speaker SPKR. A reference microphone R is provided for measuring the ambient acoustic environment and is positioned away from the typical position of a user's mouth, so that the near-end speech is minimized in the signal produced by reference microphone R. A third microphone, error microphone E, is provided in order to further improve the ANC operation by providing a measure of the ambient audio combined with the audio reproduced by speaker SPKR close to ear 5, when wireless telephone 10 is in close proximity to ear 5. Exemplary circuit 14 within wireless telephone 10 includes an audio CODEC integrated circuit 20 that receives the signals from reference microphone R, near speech microphone NS, and error microphone E and interfaces with other integrated circuits such as an RF integrated circuit 12 containing the wireless telephone transceiver. In other embodiments of the invention, the circuits and techniques disclosed herein may be incorporated in a single integrated circuit that contains control circuits and other functionality for implementing the entirety of the personal audio device, such as an MP3 player-on-a-chip integrated circuit.

In general, the ANC techniques disclosed herein measure ambient acoustic events (as opposed to the output of speaker SPKR and/or the near-end speech) impinging on reference microphone R, and also measure the same ambient acoustic events impinging on error microphone E. The ANC processing circuits of illustrated wireless telephone 10 adapt an anti-noise signal generated from the output of reference microphone R to have a characteristic that minimizes the amplitude of the ambient acoustic events present at error microphone E. Since acoustic path P(z) extends from reference microphone R to error microphone E, the ANC circuits are essentially estimating acoustic path P(z) combined with removing effects of an electro-acoustic path S(z). Electro-acoustic path S(z) represents the response of the audio output circuits of CODEC IC 20 and the acoustic/electric transfer function of speaker SPKR including the coupling between speaker SPKR and error microphone E in the particular acoustic environment. S(z) is affected by the proximity and structure of ear 5 and other physical objects and human head structures that may be in proximity to wireless telephone 10, when wireless telephone 10 is not firmly pressed to ear 5. While the illustrated wireless telephone 10 includes a two microphone ANC system with a third near speech microphone NS, other systems that do not include separate error and reference microphones can implement the above-described techniques. Alternatively, speech microphone NS can be used to perform the function of the reference microphone R in the above-described system. Finally, in personal audio devices designed only for audio playback, near speech microphone NS will generally not be included, and the near-speech signal paths in the circuits described in further detail below can be omitted.

Figure 2:
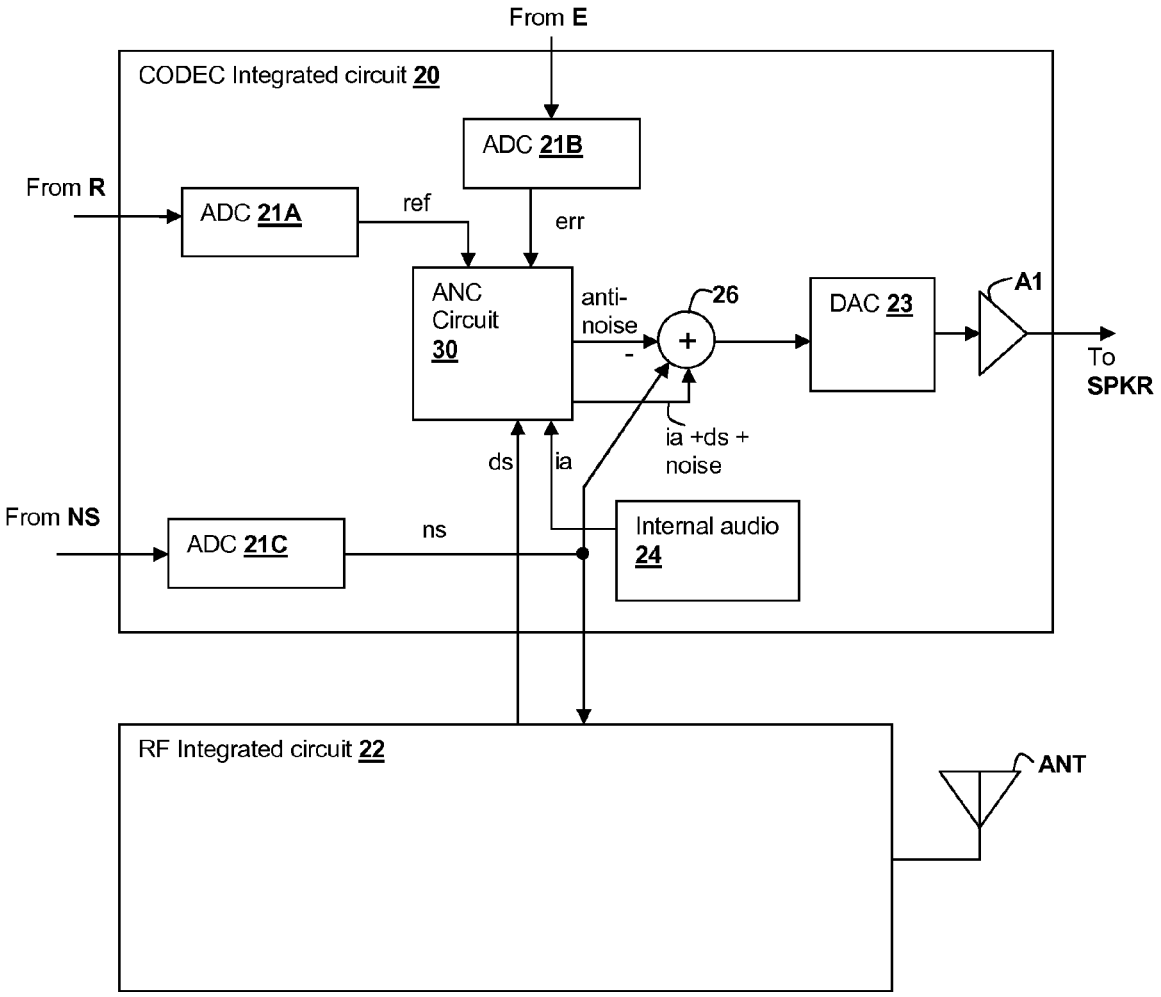
FIG. 2 is a block diagram of circuits within wireless telephone 10.

Referring now to FIG. 2, circuits within wireless telephone 10 are shown in a block diagram. CODEC integrated circuit 20 includes an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation of near speech microphone signal ns. CODEC IC 20 generates an output for driving speaker SPKR from an amplifier A1, which amplifies the output of a digital-to-analog converter (DAC) 23 that receives the output of a combiner 26. Combiner 26 combines audio signals ia from internal audio sources 24, the anti-noise signal anti-noise generated by ANC circuit 30, which by convention has the same polarity as the noise in reference microphone signal ref and is therefore subtracted by combiner 26, a portion of near speech signal ns so that the user of wireless telephone 10 hears their own voice in proper relation to downlink speech ds, which is received from radio frequency (RF) integrated circuit 22. In accordance with an embodiment of the present invention, downlink speech ds is provided to ANC circuit 30, which, intermittently injects noise bursts in place of, or in combination with source audio (ds+ia). The downlink speech ds, internal audio ia, and noise (or source audio/noise if applied as alternative signals) are provided to combiner 26, so that signal (ds+ia+noise) is always present to estimate acoustic path S(z) with a secondary path adaptive filter within ANC circuit 30. Near speech signal ns is also provided to RF integrated circuit 22 and is transmitted as uplink speech to the service provider via antenna ANT.

Figure 3A:
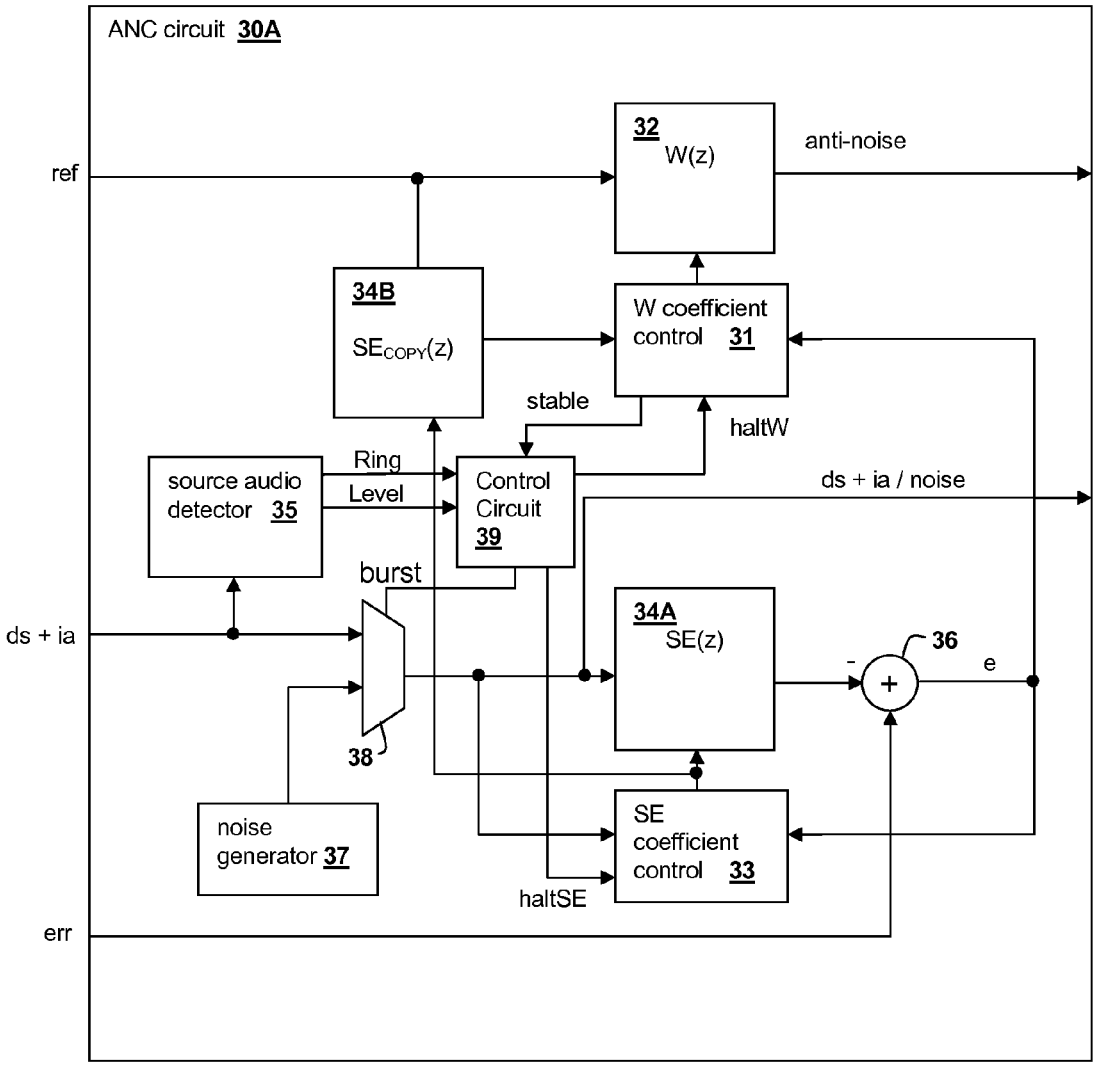
FIG. 3A is a block diagram depicting one example of signal processing circuits and functional blocks that may be included within ANC circuit 30 of CODEC integrated circuit 20 of FIG. 2.

FIG. 3A shows one example of details of ANC circuit 30A that can be used to implement ANC circuit 30 of FIG. 2. An adaptive filter 32 receives reference microphone signal ref and under ideal circumstances, adapts its transfer function W(z) to be P(z)/S(z) to generate the anti-noise signal anti-noise, which is provided to an output combiner that combines the anti-noise signal with the audio to be reproduced by the transducer, as exemplified by combiner 26 of FIG. 2. The coefficients of adaptive filter 32 are controlled by a W coefficient control block 31 that uses a correlation of two signals to determine the response of adaptive filter 32, which generally minimizes the error, in a least-mean squares sense, between those components of reference microphone signal ref present in error microphone signal err. The signals processed by W coefficient control block 31 are the reference microphone signal ref as shaped by a copy of an estimate of the response of path S(z) provided by filter 34B and another signal that includes error microphone signal err. By transforming reference microphone signal ref with a copy of the estimate of the response of path S(z), response $SE_{COPY}(z)$, and minimizing error microphone signal err after removing components of error microphone signal err due to playback of source audio, adaptive filter 32 adapts to the desired response of P(z)/S(z). In addition to error microphone signal err, the other signal processed along with the output of filter 34B by W coefficient control block 31 includes an inverted amount of the source audio including downlink audio signal ds and internal audio ia that has been processed by filter response SE(z), of which response $SE_{COPY}(z)$ is a copy. By injecting an inverted amount of source audio, adaptive filter 32 is prevented from adapting to the relatively large amount of source audio present in error microphone signal err and by transforming the inverted copy of downlink audio signal ds and internal audio ia with the estimate of the response of path S(z), the source audio that is removed from error microphone signal err before processing should match the expected version of downlink audio signal ds, and internal audio ia reproduced at error microphone signal err, since the electrical and acoustical path of S(z) is the path taken by downlink audio signal ds and internal audio ia to arrive at error microphone E. Filter 34B is not an adaptive filter, per se, but has an adjustable response that is tuned to match the response of adaptive filter 34A, so that the response of filter 34B tracks the adapting of adaptive filter 34A.

To implement the above, adaptive filter 34A has coefficients controlled by SE coefficient control block 33, which processes the source audio (ds+ia) and error microphone signal err after removal, by a combiner 36, of the above-described filtered downlink audio signal ds and internal audio ia, that has been filtered by adaptive filter 34A to represent the expected source audio delivered to error microphone E. Adaptive filter 34A is thereby adapted to generate an error signal e from downlink audio signal ds and internal audio ia, that when subtracted from error microphone signal err, contains the content of error microphone signal err that is not due to source audio (ds+ia). However, if downlink audio signal ds and internal audio ia are both absent, e.g., at the beginning of a telephone call, or have very low amplitude, SE coefficient control block 33 will not have sufficient input to estimate acoustic path S(z). Therefore, in ANC circuit 30, a source audio detector 35 detects whether sufficient source audio (ds+ia) is present, and updates the secondary path estimate if sufficient source audio (ds+ia) is present. Source audio detector 35 may be replaced by a speech presence signal if such signal is available from a digital source of the downlink audio signal ds, or a playback active signal provided from media playback control circuits. A selector 38 is provided to select between source audio (ds+ia) and the output of a noise generator 37 at an input to secondary path adaptive filter 34A and SE coefficient control block 33, according to a control signal burst, provided from control circuit 39, which when asserted, selects the output of noise generator 37. Assertion of control signal burst allows ANC circuit 30 to estimate acoustic path S(z) using the output of noise generator 37. A noise burst is thereby injected into secondary path adaptive filter 34A when a control circuit 39 temporarily selects the output of noise generator. Alternatively, selector 38 can be replaced with a combiner that adds the noise burst to source audio (ds+ia).

Control circuit 39 receives inputs from source audio detector 35, which include a Ring indicator that indicates when a remote ring signal is present in downlink audio signal ds and a Level indication when the level of the overall source audio (ds+ia) is greater than a threshold. Control circuit 39 also receives a stability indication stable from W coefficient control 31, which is generally de-asserted when $\Delta(\Sigma|W_k(z))|/\Delta t$ is greater than a threshold, but alternatively, stability indication stable may be based on fewer than all of the W(z) coefficients that determine the response of adaptive filter 32. Stability indication stable is used by control circuit 39 in some implementations to trigger injection of a noise burst and consequent update of coefficients generated by SE coefficient control block 33 and W coefficient control block 31. Control circuit 39 may implement various algorithms for determining when to inject noise bursts. Further, control circuit 39 generates control signal haltW to control adaptation of W coefficient control 31 and generates control signal haltSE to control adaptation of SE coefficient control 33. Exemplary algorithms for injection of noise bursts and sequencing of the adapting of response W(z) and secondary path estimate SE(z) are discussed in further detail below with reference to FIGS. 4-6.

Figure 3B:
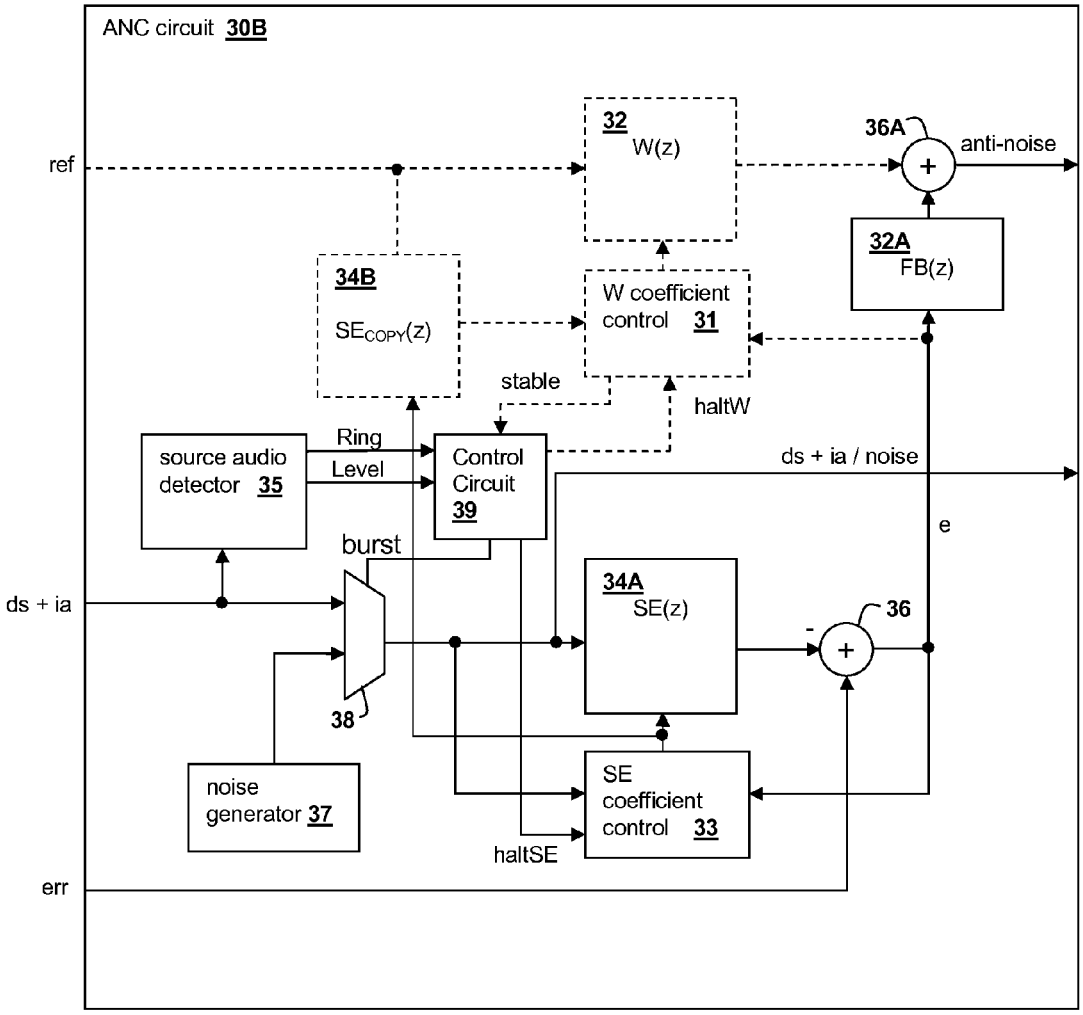
FIG. 3B is a block diagram depicting another example of signal processing circuits and functional blocks that may be included within ANC circuit 30 of CODEC integrated circuit 20 of FIG. 2.

FIG. 3B shows another example of details of an alternative ANC circuit 30B that can be used to implement ANC circuit 30 of FIG. 2. ANC circuit 30B is similar to ANC circuit 30A of FIG. 3A, so only differences between ANC circuit 30B and ANC circuit 30A will be discussed below. In the illustration, all of the components present in ANC circuit 30A of FIG. 3A are optionally present, but if the optional components and signals (shown in dashed blocks and lines) are removed, the result is a feedback noise canceling system in which the anti-noise signal is provided by filtering the error signal e with a predetermined response FB(z) using a filter 32A. Combiner 36A is not needed for the pure feedback implementation as described above, but another alternative is to provide all of the components and signals shown in ANC circuit 30A and combining the anti-noise signal generated by filter 32A with the anti-noise signal generated adaptive filter 32, which will adapt to a different response than in the implementation of ANC circuit 30A of FIG. 3A due to the presence of filter 32A.

Figure 4:
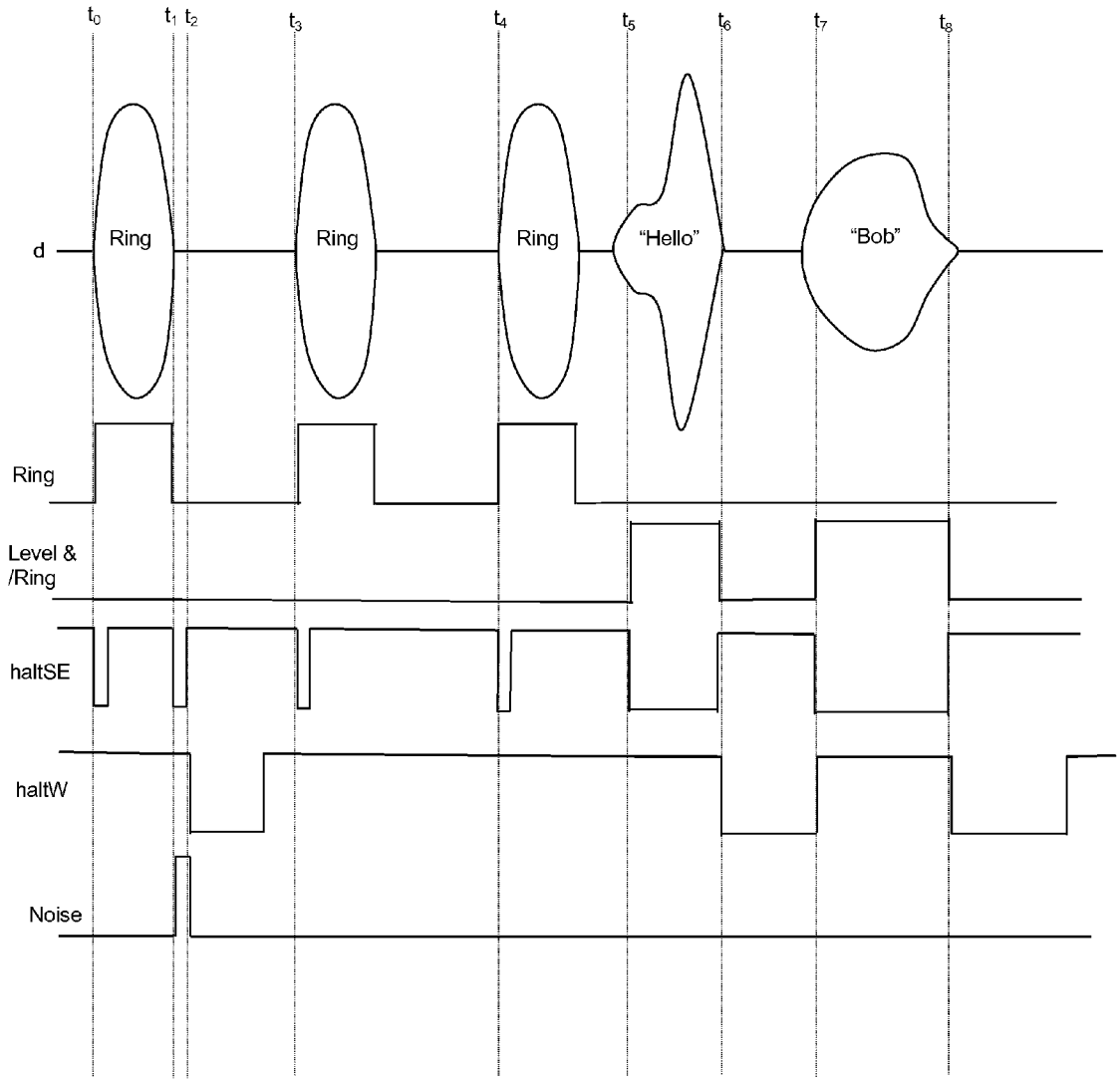
FIGS. 4-6 are signal waveform diagrams illustrating operation of ANC circuit 30 of CODEC integrated circuit 20 of FIG. 2 in accordance with various implementations.

In the example shown in FIG. 4, secondary path adaptive filter adaptation is halted by asserting control signal haltSE when remote ring tones are detected in downlink audio d at times $t_0$, $t_3$ and $t_4$. A noise burst is triggered, represented by signal Noise at time $t_1$, which is just after the first ring tone ends and control signal haltSE is de-asserted, allowing SE coefficient control 33 of FIG. 3A, or similarly update of SE coefficient control 33 of FIG. 3B), to update secondary path estimate SE(z). Then, after the noise burst is complete, control signal haltSE is again asserted and control signal haltW is de-asserted for a predetermined time period to permit response W(z) to adapt to the ambient acoustic environment. Control signal haltSE is also de-asserted when speech is detected in downlink audio d at times $t_5$ and $t_7$, as reflected in the state of a control signal Level &/Ring representing a logical and of level indication Level and the inverse of ring indication Ring, which indicates that downlink speech is present at amplitudes sufficient to properly adapt the secondary path estimate. Control signal haltW is also de-asserted at times $t_6$ and $t_8$, so that once the secondary path estimate has been updated, response W(z) is again allowed to adapt.

Figure 5:
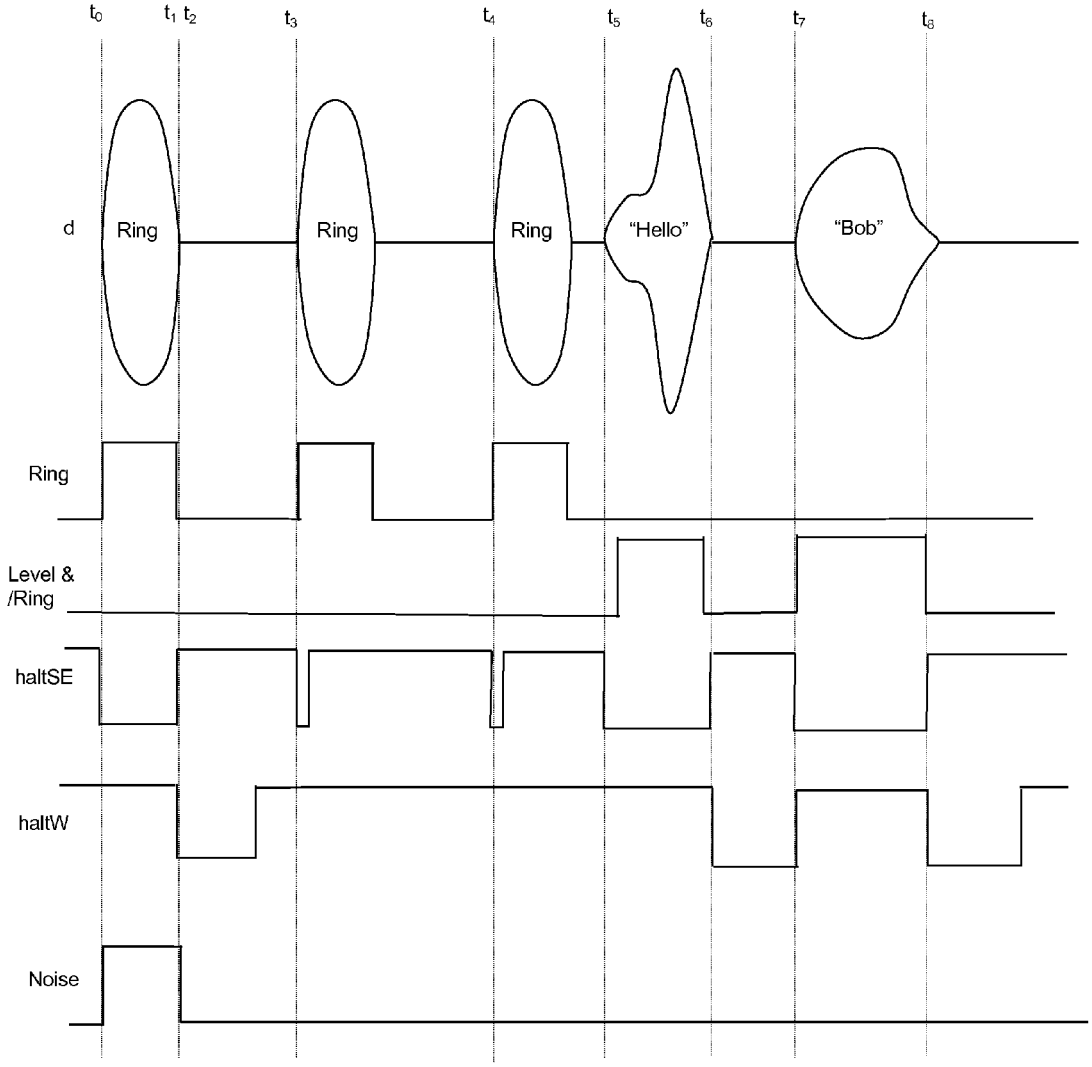

In the example shown in FIG. 5, which is an alternative to the example of FIG. 4, for the same downlink audio d waveform as in the example of FIG. 4, secondary path adaptive filter adaptation is not halted for the first remote ring tone, but is halted by asserting control signal haltSE when subsequent remote ring tones are detected in downlink audio d at times $t_3$ and $t_4$. A noise burst is triggered during the first ring tone, represented by signal Noise at time $t_0$, which is just after the first ring tone is detected. Control signal haltSE is asserted after the noise burst is terminated, which may be performed in response to detecting the end of the ring tone, or after a predetermined time period has elapsed from commencing the noise burst. Then, as in the example of FIG. 4 after the noise burst is complete, control signal haltSE is again asserted and control signal haltW is de-asserted for a predetermined time period to permit response W(z) to adapt to the ambient acoustic environment. Control signal haltSE is also de-asserted when speech is detected in downlink audio d at times $t_5$ and $t_7$, as in the example of FIG. 4.

Figure 6:
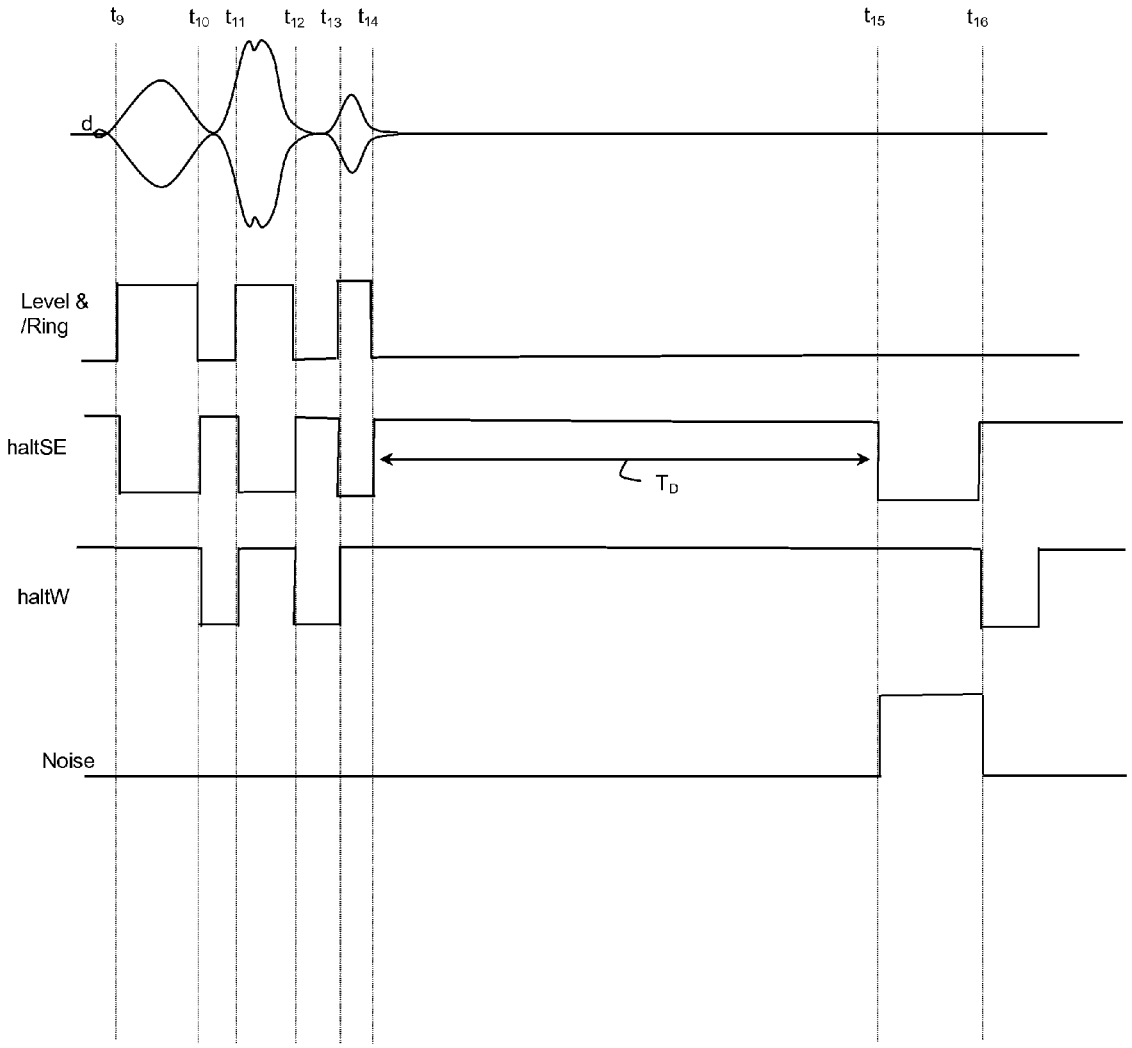

FIG. 6 illustrates a technique that can be used in combination with the example of FIG. 4 or FIG. 5. At times $t_9$, $t_{11}$ and $t_{13}$, speech is detected in downlink audio d and control signal haltSE is de-asserted to update the secondary path estimate SE(z). Control signal haltW is de-asserted, in order to update response W(z), on intervals after control signal haltSE is asserted. After a predetermined time period $T_D$ has elapsed during which there is no downlink speech in downlink signal d for adapting the secondary path estimate, and there is no ring tone to mask the noise burst as performed in the method illustrated in FIG. 5, a noise burst is injected at time $t_{15}$ and control signal haltSE is de-asserted to force an update of the secondary path estimate, during the telephone conversation in which wireless telephone 10 is participating. At time $t_{16}$, control signal haltSE is again asserted and control signal haltW is de-asserted briefly to update response W(z).

Figure 7:
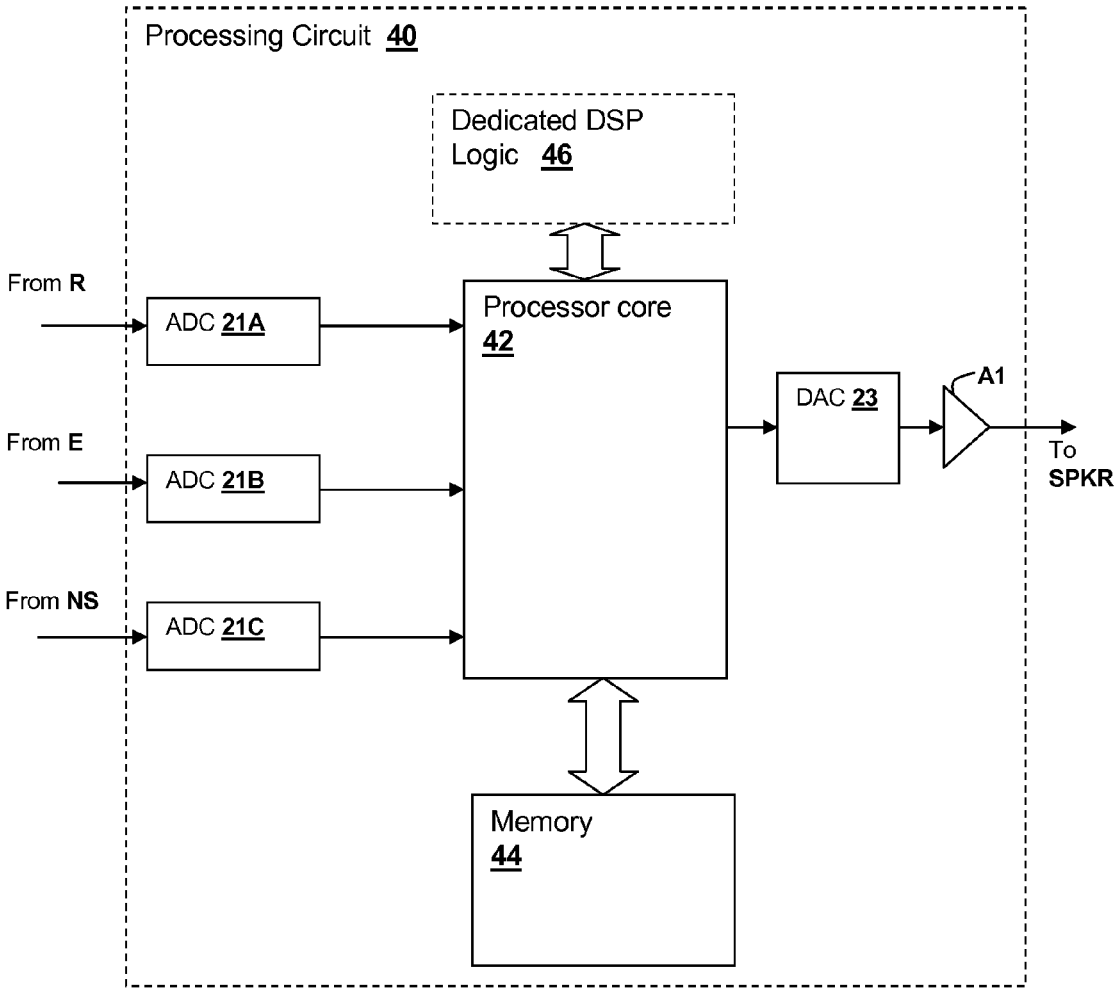
FIG. 7 is a block diagram depicting signal processing circuits and functional blocks within CODEC integrated circuit 20.

Referring now to FIG. 7, a block diagram of an ANC system is shown for implementing ANC techniques as depicted in FIG. 3A or FIG. 3B, and having a processing circuit 40 as may be implemented within CODEC integrated circuit 20 of FIG. 2. Processing circuit 40 includes a processor core 42 coupled to a memory 44 in which are stored program instructions comprising a computer-program product that may implement some or all of the above-described ANC techniques, as well as other signal processing. Optionally, a dedicated digital signal processing (DSP) logic 46 may be provided to implement a portion of, or alternatively all of, the ANC signal processing provided by processing circuit 40. Processing circuit 40 also includes ADCs 21A-21C, for receiving inputs from reference microphone R, error microphone E and near speech microphone NS, respectively. DAC 23 and amplifier Al are also provided by processing circuit 40 for providing the transducer output signal, including anti-noise as described above.

While the invention has been particularly shown and described with reference to the preferred embodiments thereof, it will be understood by those skilled in the art that the foregoing, as well as other changes in form and details may be made therein without departing from the spirit and scope of the invention.

What is claimed is:

1. A personal audio device, comprising:

a personal audio device housing;

a transducer mounted on the housing for reproducing an audio signal including both source audio for playback to a listener and a first anti-noise signal for countering the effects of ambient audio sounds in an acoustic output of the transducer;

an error microphone mounted on the housing in proximity to the transducer for providing an error microphone signal indicative of the acoustic output of the transducer and ambient audio sounds at the transducer;

a reference microphone mounted on the housing for providing a reference microphone signal indicative of the ambient audio sounds;

a noise source for providing a noise signal; and a processing circuit that implements a first adaptive filter that generates a second anti-noise signal from the reference microphone signal, a secondary path adaptive filter having a secondary path response that shapes the source audio and a combiner that removes resulting shaped source audio from the error microphone signal to provide an error signal, wherein the processing circuit filters the error signal with a predetermined response to generate a filtered error signal and combines the second anti-noise signal with the filtered error signal to yield the first anti-noise signal to reduce the presence of the ambient audio sounds heard by the listener in conformity with the error signal and the reference microphone signal, and wherein the processing circuit injects intermittent bursts of noise from the noise source into the secondary path adaptive filter and the audio signal reproduced by the transducer and permits the secondary path adaptive filter to adapt during the intermittent bursts of noise.

2. The personal audio device of claim 1, wherein the processing circuit shapes the response of the first adaptive filter in conformity with the error signal and the reference microphone signal.

3. The personal audio device of claim 2, wherein the processing circuit further controls adaptation of the first adaptive filter and the secondary path adaptive filter such that while an intermittent burst of noise is injected, the first adaptive filter is prevented from adapting and the secondary path adaptive filter is caused to adapt, and once the intermittent burst of noise has terminated, the first adaptive filter is permitted to adapt.

4. The personal audio device of claim 3, wherein the processing circuit further controls adaptation of the first adaptive filter and the secondary path adaptive filter such that once the intermittent burst of noise has terminated, the secondary path adaptive filter is prevented from adapting.

5. The personal audio device of claim 3, wherein the processing circuit determines that one or more coefficients of the first adaptive filter have a rate of change that exceeds a permitted threshold, and wherein the processing circuit injects one or more of the intermittent bursts of noise from the noise source into the secondary path adaptive filter and the audio signal reproduced by the transducer and permits the secondary path adaptive filter to adapt in response to detecting that the one or more coefficients of the first adaptive filter have the rate of change that exceeds the permitted threshold.

6. The personal audio device of claim 1, wherein the processing circuit alters a rate of adapting of the first adaptive filter while the processing circuit injects the intermittent bursts of noise.

7. The personal audio device of claim 6, wherein the processing circuit reduces a rate of adapting of the first adaptive filter while the processing circuit injects the intermittent bursts of noise.

8. The personal audio device of claim 1, wherein the processing circuit injects the one or more of the intermittent bursts of noise in response to determining that a predetermined time period has elapsed since the secondary path adaptive filter has been permitted to adapt.

9. The personal audio device of claim 8, wherein the processing circuit detects whether or not the source audio has sufficient amplitude to permit the secondary path adaptive filter to adapt, and wherein the determining that a predetermined time period has elapsed indicates that the source audio has not had sufficient amplitude to permit the secondary path adaptive filter to adapt for at least the predetermined time period.

10. The personal audio device of claim 1, wherein the processing circuit detects a remote ring signal in the source audio, and wherein the processing circuit injects one or more of the intermittent bursts of noise in response to detecting that the remote ring signal has completed.

11. The personal audio device of claim 10, wherein the processing circuit only injects the one or more of the intermittent bursts of noise after a first remote ring signal of a ring sequence and does not inject any of the intermittent bursts of noise after subsequent remote ring signals of a ring sequence.

12. The personal audio device of claim 1, wherein the processing circuit detects a remote ring signal in the source audio, and wherein the processing circuit injects one or more of the intermittent bursts of noise in response to detecting the remote ring signal and during the remote ring signal.

13. The personal audio device of claim 12, wherein the processing circuit only injects the one or more of the intermittent bursts of noise in response to detecting a first remote ring signal of a ring sequence and does not inject any of the intermittent bursts of noise during or after subsequent remote ring signals of a ring sequence.

14. The personal audio device of claim 1, wherein the processing circuit injects one or more of the intermittent bursts of noise during a telephone conversation in which the personal audio device is participating.

15. A method of countering effects of ambient audio sounds by a personal audio device, the method comprising:

providing a reference microphone signal indicative of the ambient audio sounds;

adaptively generating a first anti-noise signal to reduce the presence of the ambient audio sounds heard by the listener in conformity with the error signal and the reference microphone signal, wherein the adaptively generating generates a second anti-noise signal from the reference microphone signal with a first adaptive filter;

combining the anti-noise signal with source audio;

providing a result of the combining to a transducer;

measuring an acoustic output of the transducer and the ambient audio sounds with an error microphone;

shaping the source audio with a secondary path adaptive filter having a secondary path response that shapes the source audio;

removing resulting shaped source audio from the error microphone signal;

filtering a result of the removing with a predetermined response to provide a filtered error signal;

combining the second anti-noise signal with the filtered error signal to yield the first anti-noise signal;

injecting intermittent bursts of noise from a noise source into the secondary path adaptive filter and the audio signal reproduced by the transducer; and permitting the secondary path adaptive filter to adapt during the intermittent bursts of noise.

16. The method of claim 15, wherein the adaptively generating further comprises shaping the response of the first adaptive filter in conformity with the error signal and the reference microphone signal.

17. The method of claim 16, further comprising controlling adaptation of the first adaptive filter and the secondary path adaptive filter such that while an intermittent burst of noise is injected, the first adaptive filter is prevented from adapting and the secondary path adaptive filter is caused to adapt, and once the intermittent burst of noise has terminated, the first adaptive filter is permitted to adapt.

18. The method of claim 17, wherein the controlling controls the adaptation of the first adaptive filter and the secondary path adaptive filter such that while an intermittent burst of noise is injected, the first adaptive filter is prevented from adapting and the secondary path adaptive filter is caused to adapt, and once the intermittent burst of noise has terminated, the first adaptive filter is permitted to adapt and the secondary path adaptive filter is prevented from adapting.

19. The method of claim 17, further comprising:

determining that one or more coefficients of the first adaptive filter have a rate of change that exceeds a permitted threshold;

injecting one or more of the intermittent bursts of noise from the noise source into the secondary path adaptive filter and the audio signal reproduced by the transducer;

detecting that the one or more coefficients of the first adaptive filter have the rate of change that exceeds the permitted threshold; and responsive to detecting that the one or more coefficients of the first adaptive filter have the rate of change that exceeds the permitted threshold, permitting the secondary path adaptive filter to adapt.

20. The method of claim 15, further comprising altering a rate of the adapting of the first adaptive filter during the injecting.

21. The method of claim 20, further comprising reducing a rate of the adapting of the first adaptive filter during the injecting.

22. The method of claim 15, wherein the injecting injects the one or more of the intermittent bursts of noise in response to determining that a predetermined time period has elapsed since the secondary path adaptive filter has been permitted to adapt.

23. The method of claim 22, further comprising detecting whether or not the source audio has sufficient amplitude to permit the secondary path adaptive filter to adapt, and wherein the determining that a predetermined time period has elapsed indicates that the source audio has not had sufficient amplitude to permit the secondary path adaptive filter to adapt for at least the predetermined time period.

24. The method of claim 15, further comprising detecting a remote ring signal in the source audio, and wherein the injecting injects one or more of the intermittent bursts of noise in response to detecting that the remote ring signal has completed.

25. The method of claim 24, wherein the injecting injects the one or more of the intermittent bursts of noise only after a first remote ring signal of a ring sequence and does not inject any of the intermittent bursts of noise after subsequent remote ring signals of a ring sequence.

26. The method of claim 15, further comprising detecting a remote ring signal in the source audio, and wherein the injecting injects one or more of the intermittent bursts of noise in response to detecting the remote ring signal and during the remote ring signal.

27. The method of claim 26, wherein the injecting injects the one or more of the intermittent bursts of noise only in response to detecting a first remote ring signal of a ring sequence and does not inject any of the intermittent bursts of noise during or after subsequent remote ring signals of a ring sequence.

28. The method of claim 15, wherein the injecting injects the one or more of the intermittent bursts of noise during a telephone conversation in which the personal audio device is participating.

29. An integrated circuit for implementing at least a portion of a personal audio device, comprising:

an output for providing an output signal to an output transducer including both source audio for playback to a listener and a first anti-noise signal for countering the effects of ambient audio sounds in an acoustic output of the transducer;

an error microphone input for receiving an error microphone signal indicative of the acoustic output of the transducer and ambient audio sounds at the transducer;

a reference microphone mounted on the housing for providing a reference microphone signal indicative of the ambient audio sounds;

a noise source for providing a noise signal; and a processing circuit that implements a first adaptive filter that generates a second anti-noise signal from the reference microphone signal, a secondary path adaptive filter having a secondary path response that shapes the source audio and a combiner that removes resulting shaped source audio from the error microphone signal to provide an error signal, wherein the processing circuit filters the error signal with a predetermined response to generate a filtered error signal and combines the second anti-noise signal with the filtered error signal to yield the first anti-noise signal to reduce the presence of the ambient audio sounds heard by the listener in conformity with the error signal and the reference microphone signal, and wherein the processing circuit injects intermittent bursts of noise from the noise source into the secondary path adaptive filter and the audio signal reproduced by the transducer and permits the secondary path adaptive filter to adapt during the intermittent bursts of noise.

30. The integrated circuit of claim 29, wherein the processing circuit shapes the response of the first adaptive filter in conformity with the error signal and the reference microphone signal.

31. The integrated circuit of claim 30, wherein the processing circuit further controls adaptation of the first adaptive filter and the secondary path adaptive filter such that while an intermittent burst of noise is injected, the first adaptive filter is prevented from adapting and the secondary path adaptive filter is caused to adapt, and once the intermittent burst of noise has terminated, the first adaptive filter is permitted to adapt.

32. The integrated circuit of claim 31, wherein the processing circuit further controls adaptation of the first adaptive filter and the secondary path adaptive filter such that once the intermittent burst of noise has terminated, the secondary path adaptive filter is prevented from adapting.

33. The integrated circuit of claim 31, wherein the processing circuit determines that one or more coefficients of the first adaptive filter have a rate of change that exceeds a permitted threshold, and wherein the processing circuit injects one or more of the intermittent bursts of noise from the noise source into the secondary path adaptive filter and the audio signal reproduced by the transducer and permits the secondary path adaptive filter to adapt in response to detecting that the one or more coefficients of the first adaptive filter have the rate of change that exceeds the permitted threshold.

34. The integrated circuit of claim 29, wherein the processing circuit alters a rate of adapting of the first adaptive filter while the processing circuit injects the intermittent bursts of noise.

35. The integrated circuit of claim 34, wherein the processing circuit reduces a rate of adapting of the first adaptive filter while the processing circuit injects the intermittent bursts of noise.

36. The integrated circuit of claim 29, wherein the processing circuit injects the one or more of the intermittent bursts of noise in response to determining that a predetermined time period has elapsed since the secondary path adaptive filter has been permitted to adapt.

37. The integrated circuit of claim 36, wherein the processing circuit detects whether or not the source audio has sufficient amplitude to permit the secondary path adaptive filter to adapt, and wherein the determining that a predetermined time period has elapsed indicates that the source audio has not had sufficient amplitude to permit the secondary path adaptive filter to adapt for at least the predetermined time period.

38. The integrated circuit of claim 29, wherein the processing circuit detects a remote ring signal in the source audio, and wherein the processing circuit injects one or more of the intermittent bursts of noise in response to detecting that the remote ring signal has completed.

39. The integrated circuit of claim 38, wherein the processing circuit only injects the one or more of the intermittent bursts of noise after a first remote ring signal of a ring sequence and does not inject any of the intermittent bursts of noise after subsequent remote ring signals of a ring sequence.

40. The integrated circuit of claim 29, wherein the processing circuit detects a remote ring signal in the source audio, and wherein the processing circuit injects one or more of the intermittent bursts of noise in response to detecting the remote ring signal and during the remote ring signal.

41. The integrated circuit of claim 40, wherein the processing circuit only injects the one or more of the intermittent bursts of noise in response to detecting a first remote ring signal of a ring sequence and does not inject any of the intermittent bursts of noise during or after subsequent remote ring signals of a ring sequence.

42. The integrated circuit of claim 29, wherein the processing circuit injects one or more of the intermittent bursts of noise during a telephone conversation in which the personal audio device is participating.

* * * * *